US005948604A

United States Patent [19]

Craver et al.

[11] Patent Number: 5,948,604

[45] Date of Patent: Sep. 7, 1999

[54] SINGLE-USE PROCESSING KIT FOR PROCESSING COLOR REVERSAL PHOTOGRAPHIC ELEMENTS

[75] Inventors: Mary E. Craver, Rochester; Jean M. Buongiorne, Brockport; Michael J. Haight, Rochester, all of N.Y.

[73] Assignee: Eastman Kodak Company, Rochester, N.Y.

[21] Appl. No.: 09/132,629

[22] Filed: Aug. 11, 1998

[51] Int. Cl.[6] ..... G03C 7/413

[52] U.S. Cl. ..... 430/458; 430/450; 430/466

[58] Field of Search ..... 430/450, 458, 430/466

[56] References Cited

U.S. PATENT DOCUMENTS

| | | | |
|---|---|---|---|
| 3,617,282 | 11/1971 | Bard et al. | 430/379 |
| 3,790,381 | 2/1974 | Fisch et al. | 430/466 |
| 4,921,779 | 5/1990 | Cullinan et al. | 430/379 |
| 4,975,356 | 12/1990 | Cullinan et al. | 430/393 |
| 5,037,725 | 8/1991 | Cullinan et al. | 430/372 |
| 5,204,230 | 4/1993 | Hayashi | 430/466 |
| 5,523,195 | 6/1996 | Darmon et al. | 430/393 |
| 5,552,264 | 9/1996 | Cullinan et al. | 430/372 |
| 5,736,302 | 4/1998 | Buongiorne et al. | 430/379 |
| 5,843,630 | 12/1998 | Masson | 430/466 |

*Primary Examiner*—Hoa Van Le
*Attorney, Agent, or Firm*—J. Lanny Tucker

[57] ABSTRACT

A processing kit for color reversal photographic elements includes several concentrate compositions that can be used to prepare the necessary working strength processing solutions. Each concentrate composition is packaged in a volume that is designed for dilution to the same predetermined working strength solution volume for a single use in color reversal processing.

13 Claims, No Drawings

SINGLE-USE PROCESSING KIT FOR PROCESSING COLOR REVERSAL PHOTOGRAPHIC ELEMENTS

COPENDING APPLICATIONS

Copending and commonly assigned U.S. Ser. No. 09/132,201, filed on even date herewith by Buongiorne, Haight and Craver, and entitled "Photographic Reversal Bath Concentrate Free of Biocide and Method of Use".

FIELD OF THE INVENTION

This invention relates to a single-use photographic processing kit comprising several photoprocessing liquid concentrates useful in the processing of color reversal photographic films. This invention also relates to a method of preparing working strength processing solutions using the concentrates of the single-use photographic processing kit.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, the materials utilize color forming couplers or dyes in the sensitized layers during processing.

One commercially important process intended for color reversal photographic films useful for providing positive color images, can include the following sequence of processing steps: first (or black-and-white) development, washing, reversal reexposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al).

Generally, the photographic processing solutions used for the various processing steps noted above are either supplied as bulk working strength solutions, or as individual concentrates that are appropriately diluted as replenisher solutions in various processing apparatus. Such applications are generally limited to large tank processing apparatus.

A market has developed in recent years, such as in some of the less developed countries of the world or for hobbyists, for processing of color reversal films in small volume processors or in what are known as "rotary tubes" wherein a number of film strips are immersed sequentially in the appropriate processing solutions, which are then discarded. The various processing solutions needed for such low volume uses can be purchased individually and used any number of times, but this would require the users to keep and manage a varying supply of the various solutions on hand. There would be considerable convenience if the users had a single kit of processing solutions that could be purchased, managed and discarded as a unit.

Fuji Hunt's "4 Step E6 Processing Kit" NT 535-1 is commercially available but has limited utility since it is designed for only four processing steps, namely black and white development, color development, bleach/fixing and final stabilizing. Many commercially available color reversal films cannot be optionally processed using this processing kit. Another commercially available processing kit from Fuji Hunt has only three processing solutions (black and white developer, color developer and bleach/fix).

Similarly, AGFA has marketed its AP 44 One-Shot Color Film Reversal processing kit, but it is limited to only six processing solutions because the stabilizing step must be performed outside the processor due to odor. In addition, the solutions in the processing kit are provided in different volumes, any deviation from which adversely affects sensitometric results.

Tetenal of Europe provides various volume processing kits having either three or six processing solutions. Similar disadvantages are evident.

There is a need in the photographic industry for a processing kit that is easily used only once for processing color reversal elements from any manufacturer.

SUMMARY OF THE INVENTION

An advance in the art is provided with a single-use photographic processing kit comprising multiple photographic photoprocessing liquid concentrates, each concentrate having a volume designed for dilution to the same predetermined volume of working strength photographic processing composition, the kit comprising:

a) a single-part black and white photographic developing concentrate composition, b) a single-part photographic reversal concentrate composition, c) two-part photographic color developing concentrate compositions, d) a single-part photographic prebleach concentrate composition, e) a single-part photographic bleaching concentrate composition, f) a single-part photographic fixing concentrate composition, and g) a single-part final rinsing concentrate composition.

The processing kit of this invention provides a number of important advantages for the photographic industry. Its components are designed for "single-use", that is processing a batch of one or more color reversal elements, and then being discarded. All of the concentrate compositions have quality chemical formulations at volumes such that when each is diluted to the same predetermined volume, the results are ready-to-use working strength solutions. Thus, all of the chemical compositions are readily scaleable to useful volumes at the dilution rate. These simplifications make processing relatively easy and convenient, reduce the possibilities for operator error, and render the chemical components adaptable to desirable package designs. There is less environmental impact from the photochemicals of the processing kit because the chemistry in the concentrates has been optimized to provide the highest quality at the lowest practical concentration of the various photochemicals, taking packaging and costs into consideration.

The processing kit of this invention is particularly useful in rotary tube, small tank and other low volume processing apparatus that is becoming common in less developed countries in the world.

DETAILED DESCRIPTION OF THE INVENTION

The processing kit comprises seven essential chemical concentrates, and can also include optional chemical components, metering devices, instructions and other common addenda used with photographic processing kits. All of the kit components can be conveniently provided in a single package of any suitable design. The chemical components are generally packaged in suitable container such as glass or plastic bottles, vials, syringes, packettes, or partially or wholly collapsible containers (such as containers described in U.S. Pat. No. 5,577,614 of Palmeroni, Jr. et al). They are preferably in aqueous form, but it is possible that one or more chemical components can be provided in solid form (either as powder, granules or tablets).

In one preferred kit arrangement, there is a single container of each of the black and white photographic developing concentrate composition, the photographic reversal concentrate composition, the photographic prebleach concentrate composition, the photographic fixing concentrate composition and the photographic final rinsing concentrate composition. In addition, this kit includes a single container of each of the two parts of color developer part concentrates, and one or two containers of the single-part photographic bleaching concentrate composition.

Black and White Developing Concentrate:

A single-part black and white developing concentrate composition is an essential component of the processing kit. Such compositions generally include one or more black and white developing agents (such as dihydroxybenzenes or derivatives thereof, ascorbic acid or derivatives thereof, aminophenol and 3-pyrazolidone type developing agents) that are well known in the art, including U.S. Pat. No. 5,187,050 (Yamada et al), U.S. Pat. No. 5,683,859 (Nothnagle et al) and U.S. Pat. No. 5,702,875 (Opitz et al), both incorporated herein by reference. Dihydroxybenzenes and their derivatives (and salts), such as hydroquinone sulfonate, are preferred.

It is particularly desirable to include a 3-pyrazolidone auxiliary developing agent. Such compounds are also described in U.S. Pat. No. 5,683,859 (noted above). A most preferred auxiliary developing agent is 4-(hydroxymethyl)-4-methyl-1-phenyl-3-pyrazolidone.

The black and white developing concentrate composition generally includes other chemicals common to black and white developers including, but not limited to, buffering agents (such as carbonates and bicarbonates), sulfite preservatives (including bisulfites and sulfites), anti-sludging agents, antifoggants, antioxidants, stabilizing agents, contrast-promoting agents, metal ion sequestering agents (such as polyphosphonic acids and aminopolycarboxylic acids and salts thereof), halides (such as iodide and bromide salts), hydroxides, and silver metal solvents (such as thiocyanates).

The pH of such concentrates (if in liquid form) can vary considerably, but is generally from about 9 to about 12, and preferably from about 9.5 to about 11.5. A more preferred pH is from about 9.6 to about 10.

The amounts of the components in the black and white developing concentrate composition can vary considerably in view of the considerable teaching in the art. With routine experimentation and the teaching provided herein, a skilled worker can determine both useful and optimum concentrations of the components. A particularly useful concentrate composition is shown in Example 1 below.

Reversal Concentrate:

Photographic reversal compositions are also known in the art, including for example U.S. Pat. No. 3,617,282 (Bard et al) and U.S. Pat. No. 5,736,302 (Buongiorne et al), both incorporated herein by reference. The concentrated compositions used in this invention are provided as a single part, and if in liquid form generally have a pH of from about 4.5 to about 6, and preferably from about 5.2 to about 5.6. Chemical components generally included therein include a source of stannous ions (such as stannous chloride, stannous bromide, stannous acetate and stannous fluoride), one or more metal ion chelating agents in an amount of at less than 0.6 mol/l (such as polyphosphonic or polyphosphinic acids or aminocarboxylic acids or salts thereof), one or more biocides, hydroxides, surfactants, antioxidants, buffering agents, and stannous ion stabilizers (such as p-aminophenol).

The useful and optimal amounts of such components can be readily determined in view of the teaching provided herein as well as in the cited art (for example, from about 0.2 to about 0.3 mol/l of the chelating agent, from about 0.1 to about 0.3 mol/l of stannous ions, and from about 0.000025 to about 0.000125 mol/l of a stannous ion stabilizer). A most preferred reversal concentrate composition is shown in Example 1 below. Further details of such concentrate compositions and methods of preparation, especially when propionic acid and biocides such as quaternary ammonium compounds are omitted, are provided in copending and commonly assigned U.S. Ser. No. 09/132, 201 of Buongiorne, Haight and Craver, noted above.

Color Developing Concentrates:

The color developing used in processing color reversal elements is provided in the processing kit of this invention as two parts, each of which is in concentrated form. When these two parts are combined, diluted or undiluted, they comprise all of the chemical components conventionally used for color development, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (Cullinan et al) and U.S. Pat. No. 5,552,264 (Cullinan et al), both incorporated herein by reference.

The two part concentrates of this invention generally have the color developing agents and sulfite preservatives in one part, and all of the remaining chemicals in the other part. The pH of the resulting composition (if in liquid form) when both parts are combined is generally from about 9 to about 13, preferably from about 11.5 to about 12.5, and more preferably from about 12.0 to about 12.2.

Prebleach Concentrate:

Another essential component of the processing kit of this invention is a single-part concentrate composition that provides dye image stabilization. If in liquid form, this composition generally has a pH of from about 5.5 to about 8, and includes a dye stabilization compound (such as an alkali metal formaldehyde bisulfite, hexamethylenetetramine and various formaldehyde releasing compounds), buffering agents, bleach-accelerating compounds, secondary amines, preservatives, and metal sequestering agents. All of these compounds are well known in the art, including U.S. Pat. No. 4,839,262 (Schwartz), U.S. Pat. No. 4,921,779 (Cullinan et al), U.S. Pat. No. 5,037,725 (Cullinan et al), U.S. Pat. No. 5,523,195 (Darmon et al) and U.S. Pat. No. 5,552,264 (Cullinan et al), all incorporated herein by reference.

The amounts of the various components of the prebleach concentrate would be readily apparent to one skilled in the art in view of the teaching in the noted references. A preferred prebleach concentrate composition is shown in Example 1 below.

Bleaching Concentrate:

The bleaching concentrate composition is also provided as a single-part. If in liquid form, it generally has a pH of from about 4 to about 6.5 (preferably from about 5.3 to about 5.8), and includes one or more suitable ferric ion chelate bleaching agents. Such compounds generally include one or more aminopolycarboxylic or polyaminopolycarboxylic acid chelating ligands (or salts thereof), of which there are hundreds of possibilities. Preferred chelating ligands include ethylenediaminetetraacetic acid, methyliminodiacetic acid, β-alaninediacetic acid, ethylenediaminedisuccinic acid, ethylenediaminemonosuccinic acid, 1,3-propylenediaminetetraacetic acid, nitrilotriaacetic acid, and 2,6-pyridinedicarboxylic acid. Most preferred is ethylenediaminetetraacetic acid. Other components of the bleaching concentrate include buffering agents, metal ion sequestering agents (such as polyphosphonic acids and salts thereof), corrosion inhibitors (such as nitrates), halides and acids or bases for pH adjustment. These components and useful and optimal amounts are well known in the art, for example U.S. Pat. No. 5,652,087 (Craver et al), incorporated herein by reference, and U.S. Pat. Nos. 4,839,262, 4,921,779, 5,037,725, 5,523,195 and 5,552,264, all noted above.

Particularly preferred bleaching concentrates have a pH of from about 4 to about 6.5, and include a ferric ion chelate bleaching agent (as defined above), nitrate ions present in an amount of 1 mol/l or less (and preferably from about 0.05 to about 0.5 mol/l), and from about 0.4 to about 2 mol/l of bromide ion, wherein from about 60 to about 97 mol % (preferably from about 60 to about 80 mol %) of the bromide ion being provided by a bromide salt (such as ammonium bromide, sodium bromide or potassium bromide) and the remainder supplied by hydrobromic acid. These concentrates are advantageous because of lowered volume and environmental impact. A preferred bleaching composition is described in Example 1 below.

Fixing Concentrate:

A single-part fixing concentrate composition is included in the processing kit of this invention. If in liquid form, it has a pH of from about 6 to about 7, and generally includes one or more fixing agents (thiosulfates or thiocyanates), fixing accelerators, buffering agents, metal ion sequestering agents, and preservatives (such as sulfites). These various components and useful and optimal amounts are well known in the art, for example U.S. Pat. No. 5,424,176 (Schmittou et al) and U.S. Pat. Nos. 4,839,262, 4,921,779, 5,037,725, 5,523,195 and 5,552,264, all noted above. A preferred fixing concentrate is described in Example 1 below.

In some embodiments, the fixing solution can also include an optical brightener such as a triazinylstilbene and a water-soluble aliphatic stabilizing compound such as a glycol or alcoholamine (diethylene glycol and triethanolamine being preferred). Details of such fixing compositions are provided in copending and commonly assigned U.S. Ser. No. 09/109,466 filed Jul. 6, 1998 by Craver and Buongiorne.

Final Rinsing Concentrate:

A single-part final rinse concentrate composition of this invention generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al), all of which are incorporated herein by reference. The useful and optimal amounts of the various components would also be apparent to one skilled in the art. A preferred final rinsing concentrate is described in Example 1 below.

The various components of the processing kits have predetermined volumes such that a particular predetermined dilution rate can be used with each concentrate to provide the same predetermined working strength volume, for example 1, 5 or 15 liters. For example, to provide 1 liter working strength solutions for each processing composition, the following dilution rates would be used for the given kit components:

5 times for component a), 40 times for component b), 10 times for the Part A of component c), 21.2 times for Part B of component c), 10 times for component d), 3.2 times for component e), 14.3 times for component f), and 64.1 times for component g).

A wide variety of color reversal photographic elements can be processed using the diluted concentrates of the processing kit. A detailed description of such materials is found, for example, in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

Color reversal photographic elements that can be processed in this invention are comprised of a support having a plurality of photosensitive silver halide emulsion layers. These layers can comprise any of the many conventional photosensitive silver halides, and mixtures thereof, in suitable binder materials. Preferred color reversal elements are color reversal films utilizing polymeric films as supports with a plurality of silver bromoiodide photosensitive emulsion layers.

Some commercially available color reversal films that can be processed using the processing kit of the present invention include EKTACHROME Color Reversal Films (Eastman Kodak Company), AGFACHROME Color Reversal Films (Agfa), FUJICHROME Color Reversal Films (Fuji Photo Film Co.), KONICACHROME Color Reversal Films (Konica) and SCOTCHCHROME Color Reversal Films (3M Corporation).

The following examples are provided for illustrative purposes only and are not intended to be limiting in any way. Unless otherwise indicated, all percentages are by weight.

EXAMPLE 1

Preferred Processing Kit

A processing kit for processing color reversal films contains bottles of the following concentrates:

| Single-Part Black and White Developing Concentrate: | |
|---|---|
| Water | 557.01 g |
| Potassium iodide | 0.022 g |
| Potassium sulfite (45% solution) | 308.55 g |
| Sodium thiocyanate (51% solution) | 9.81 g |
| DEQUEST 2000 (40% solution)* | 4.12 g |
| Sodium bromide | 13.36 g |

-continued

| | |
|---|---|
| Potassium hydroxide (45.5% solution) | 53.04 g |
| Versenex 80 (40% solution)* | 31.3 g |
| 4-Hydroxymethyl-4-methyl-1-phenyl-3-pyrazolidone | 5.69 g |
| Potassium carbonate (47% solution) | 138.72 g |
| Sodium bicarbonate | 52.86 g |
| Potassium hydroquinone monosulfate | 91.9 g |
| Single-Part Reversal Concentrate: | |
| Tap water | 624.4 g |
| Glacial acetic acid | 126 g |
| NaOH (50%) | 120 g |
| DEQUEST 2006* (40% solution) | 256.6 g |
| Stannous chloride | 39.6 g |
| p-Aminophenol | 0.012 g |
| Two-Part Color Developing Concentrates: | |
| Part A: | |
| Water | 738.12 g |
| 2,2-Ethylenedithiodiethanol (Tegochrome 22 from Goldschmidt) | 3.6 g |
| Potassium iodide | 0.147 g |
| Potassium hydroxide (45.5% solution) | 278.64 g |
| DEQUEST 2000 (50% solution)* | 20.5 g |
| Sodium hydroxide (50% solution) | 13.75 g |
| Sodium bromide | 1 g |
| Phosphoric acid (75% solution) | 80.9 g |
| Sodium sulfite, anhydrous | 29.85 g |
| Citrazinic acid | 2.79 g |
| Part B: | |
| Water | 883.78 g |
| Sodium metabisulfite | 2.1 g |
| EASTMAN Color Developer CD-3 | 176.8 g |
| Sodium metabisulfite | 4.21 g |
| Single-Part Prebleach Concentrate: | |
| Water | 672.61 g |
| Formaldehyde (37% solution, 12% methanol) | 150.3 g |
| Sodium metabisulfite | 181.7 g |
| Potassium sulfite (45% solution) | 136.8 g |
| 1-Thioglycerol (90% solution) | 5.18 g |
| Ethylenediaminetetraacetic acid | 30 g |
| Phosphoric acid (75% solution) | 13.3 g |
| Potassium hydroxide | 14.2 g |
| Single-Part Bleaching Concentrate: | |
| Water | 365.3 g |
| Potassium nitrate | 32.2 g |
| Ammonium bromide | 177.53 g |
| Solution 3422 (1.56 molar ammonium FeEDTA solution) (Dow Chemical) | 596.8 g |
| Hydrobromic acid (48% solution) | 106.16 g |
| Single-Part Fixing Concentrate: | |
| Water | 21.5 g |
| Solution of ammonium thiosulfate (56.5% | 1246.6 g |
| Ethylenediaminetetraacetic acid | 5.89 g |
| Sodium metabisulfite | 71.23 g |
| Sodium hydroxide (50% solution) | 19.9 g |
| Single-Part Final Rinse Concentrate: | |
| Water | 971.16 g |
| PROXEL GXL biocide (17% solution) | 19.4 g |
| RENEX 30 nonionic surfactant (ICI) | 9.19 g |
| Glacial acetic acid | 0.25 g |

*DEQUEST 2000 contains aminotris(methylenephosphonic acid) chelating agent (Montsanto).
Versenex 80 is available from Dow Chemical Co. and contains a polyaminopolycarboxylic acid
*DEQUEST 2006 contains aminotris(methylenephosphonic acid), pentasodium salt (Monsanto).

EXAMPLE 2

Working Strength Reversal Solution and Method of Processing

Working strength solutions (each 1 liter) were prepared by diluting each of the concentrates of Example 1 as noted below (ml of concentrate per liter of working strength solution). These solutions were used in the following processing protocol:

| PROCESSING STEP | ml CONC./LITER SOLUTION | TIME (minutes) | TEMPERATURE (° C.) |
|---|---|---|---|
| Black & white development | 200 | 6 | 38 |
| Water washing | — | 2 | 38 |
| Reversal step | 25 | 2 | 38 |
| Color development | 200 (Part A)<br>47 (Part B) | 5 | 38 |
| Prebleach | 100 | 2 | 38 |
| Bleaching | 310 | 6 | 38 |
| Fixing | 70 | 4 | 38 |
| Water washing | — | 4 | 38 |
| Final rinsing | 15.6 | 0.5 | 38 |

Samples of several commercially available color reversal films were tested using these processing solutions and conditions, and the desired color positive images were obtained. The tested films included samples of EKTACHROME Color Reversal Films (Eastman Kodak Company), AGFACHROME Color Reversal Films (Agfa), FUJICHROME Color Reversal Films (Fuji Photo Film Co.), KONICACHROME Color Reversal Films (Konica) and SCOTCHCHROME Color Reversal Films (3M Corporation).

The invention has been described in detail with particular reference to preferred embodiments thereof, but it will be understood that variations and modifications can be effected within the spirit and scope of the invention.

We claim:

1. A single-use photographic processing kit comprising multiple photographic photoprocessing liquid concentrates, each concentrate having a volume designed for dilution to the same predetermined volume of working strength photographic processing composition:

a) a single-part black and white photographic developing concentrate composition, b) a single-part photographic reversal concentrate composition, c) two-part photographic color developing concentrate compositions, d) a single-part photographic prebleach concentrate composition, e) a single-part photographic bleaching concentrate composition, f) a single-part photographic fixing concentrate composition, and g) a single-part final rinsing concentrate composition.

2. The processing kit of claim 1 wherein said single-part black and white photographic developing concentrate composition has a pH of from about 9.5 to about 11.5 and comprises a black and white developing agent and a 3-pyrazolidone auxiliary developing agent.

3. The processing kit of claim 2 wherein said single-part black and white photographic developing concentrate composition comprises a dihydroxybenzene derivative developing agent and 4-(hydroxymethyl)-4-methyl-1-phenyl-3-pyrazolidone as the auxiliary developing agent.

4. The processing kit of claim 1 wherein said single-part photographic reversal concentrate composition has a pH of from about 4.5 to about 6, and comprises stannous ions, an organic phosphonic acid or phosphinic acid metal ion chelating agent in an amount of less than 0.6 mol/l, and a stannous ion stabilizer, said reversal concentrate composition being free of propionic acid and quaternary ammonium compounds.

5. The processing kit of claim 4 wherein said single-part photographic reversal concentrate composition has a pH of from about 5.2 to about 5.6, said chelating agent is present in an amount of from about 0.2 to about 0.3 mol/l, stannous ions are present in an amount of from about 0.1 to about 0.3 mol/l, and said stannous ion stabilizer is present in an amount of from about 0.000025 to about 0.000125 mol/l.

6. The processing kit of claim 1 wherein said bleaching concentrate has a pH of from about 4 to about 6.5 and comprises:

a ferric ion chelate bleaching agent, nitrate ion in an amount of less than 1 mol/l, and from about 0.4 to about 2 mol/l of bromide ion wherein from about 60 to about 97 mol % of said bromide ion is provided by a bromide salt and the remainder from hydrobromic acid.

7. The processing kit of claim 6 wherein said bleaching concentrate has a pH of from about 5.3 to about 5.8 and comprises:

a ferric ethylenediaminetetraacetic acid chelate bleaching agent, nitrate ion in an amount of from about 0.05 to about 0.5 mol/l, and from about 60 to about 80 mol % of said bromide ion is provided by a bromide salt and the remainder from hydrobromic acid.

8. The processing kit of claim 1 wherein said two-part photographic color developing concentrate compositions can be combined to provide a color developing solution comprising a color developing agent, and having a pH of from about 11.5 to about 12.5.

9. The processing kit of claim 8 wherein two-part photographic color developing concentrate compositions can be combined to provide a color developing solution having a pH of from about 12 to about 12.2.

10. The processing kit of claim 1 wherein comprising at least one container of each of a), b), d), e), f) and g), one container for each of the two parts of c).

11. The processing kit of claim 1 wherein said components a) through g) are diluted as follows to prepare said same predetermined volume of working strength photographic processing composition for each component:

5 times for component a), 40 times for component b), 10 times for Part A of component c), 21.2 times for Part B of component c), 10 times for component d), 3.2 times for component e), 14.3 times for component f), and 64.1 times for component g).

12. The processing kit of claim 1 wherein said components a) through g) are provided in a single package.

13. The processing kit of claim 1 wherein each of said components a) through g) are packaged in a plastic bottle, packette or partially or wholly collapsible container.

* * * * *